US006237689B1

(12) United States Patent
Wardlaw

(10) Patent No.: US 6,237,689 B1
(45) Date of Patent: May 29, 2001

(54) METHOD FOR CONFIRMING THE INTEGRITY OF A SEAL SYSTEM WITHIN A SUBTERRANEAN WELL CONDUIT CHRISTMAS TREE VALVE ASSEMBLY

(76) Inventor: Louis J. Wardlaw, 5322 Addicks-Satsuma Rd., Houston, TX (US) 77284

( * ) Notice: Subject to any disclaimer, the term of this patent is extended or adjusted under 35 U.S.C. 154(b) by 0 days.

(21) Appl. No.: 09/145,210

(22) Filed: Aug. 31, 1998

(51) Int. Cl.[7] ..... E21B 33/03

(52) U.S. Cl. ..... 166/337; 166/250.08; 166/368; 166/387

(58) Field of Search ..... 166/336, 337, 166/368, 387, 250.08

(56) References Cited

U.S. PATENT DOCUMENTS 3,661,206 * 5/1972 Putch et al. ..... 166/85
3,847,215 * 11/1974 Herd ..... 166/315 X
4,886,121 * 12/1989 Demny et al. ..... 166/382
5,884,706 * 3/1999 Edwards ..... 166/335

* cited by examiner

*Primary Examiner*—Roger Schoeppel
(74) *Attorney, Agent, or Firm*—Beirne Maynard & Parsons, L.L.P.

(57) ABSTRACT

Method and apparatus are disclosed for confirming the integrity of a seal system extending between a conduit disposed within a subterranean well and a surface or top Christmas tree assembly such that the confirmation steps do not adversely thereafter effect the sealing integrity of the system when exposed to high pressure and/or temperature environments.

1 Claim, 2 Drawing Sheets

METHOD FOR CONFIRMING THE INTEGRITY OF A SEAL SYSTEM WITHIN A SUBTERRANEAN WELL CONDUIT CHRISTMAS TREE VALVE ASSEMBLY

BACKGROUND OF THE INVENTION (1) Field of the Invention

The invention relates to an apparatus and method for confirming the integrity of a seal system positioned within a subterranean well Christmas tree and one or more conduits, such as production tubing and/or casing, held therein.

(2) Background of the Invention

Casing and production tubing are disposed within a subterranean well subsequent to the drilling, workover or completion thereof. A length of casing having the largest diameter is first introduced at the top of the well through which a smaller diameter length of casing also is introduced for extension below the lowermost end of the largest diameter casing and secured to the lowermost end of the largest diameter casing by means of a liner hanger. Thereafter, the series of casing conduit sections may be telescopically concentrically disposed within the well, depending upon the depth of the well and the location of the production zone or zones. Typically, the smallest diameter casing section will carry interior thereof a length of production tubing. The uppermost conduits are secured together at the top surface of the well through a "Christmas tree" which is a valving system holding the casing and production conduits in sealed relationship and having valving mechanisms for controlling fluid flow therethrough.

Conventional methods of testing wellhead and Christmas tree cavities defined between the housing of the Christmas tree and the outer diameter of one of the conduit members employ the use of oils or water fluids. Temperatures encountered during flowing conditions of high pressure, high temperature wells have the potential to heat these fluids to a point where the fluid expansion can potentially collapse the metal seal sleeves and elastomeric seals. Additionally, the use of water can ultimately cause corrosion to metal parts, and the use of oil can ultimately degrade elastomers.

The present invention is directed to the problems as above addressed.

SUMMARY OF THE INVENTION

A method is provided for confirming the sealing integrity of a seal system having members positioned in a cavity between a subterranean well conduit, such as casing, or production tubing, and an interior sealing surface of a Christmas tree valve assembly. The method includes the steps of first introducing through a sealable opening of an injection path in communication with the cavity and into the cavity between the seal members a first inert gas combined with a gaseous hydrocarbon marker such as helium, freon or propane for detecting the presence of the inert gas exterior of the Christmas tree assembly. The pressure within the cavity is increased to a first pre-determinable amount. The absence of the marker in the atmosphere immediate the exterior of the Christmas tree is then verified. If the verification step confirms the absence of the gaseous hydrocarbon marker immediate the cavity, the pressure within the cavity is decreased to a second pre-determinable amount, which is lower than the first pre-determinable amount and the injection path then is sealed.

The invention also provides an apparatus for confirming the integrity of the seal system within the Christmas tree, means such as an injector extending from a line in communication with a compressor and a pump is introduced into the cavity and between the seal members to inject through the injection path into the cavity a first inert gas combined with the hydrocarbon marker. Means including a compressor and/or pump are used to apply pressure within the cavity to the inert gas and hydrocarbon marker to a pre-determinable amount and, once the absence of the marker in the atmosphere immediate the exterior of the Christmas tree is verified, are used to decrease the pressure within the cavity to a second pre-determinable amount which is lower than the first pre-determinable amount.

DESCRIPTION OF THE PREFERRED EMBODIMENTS

Figure 1A:
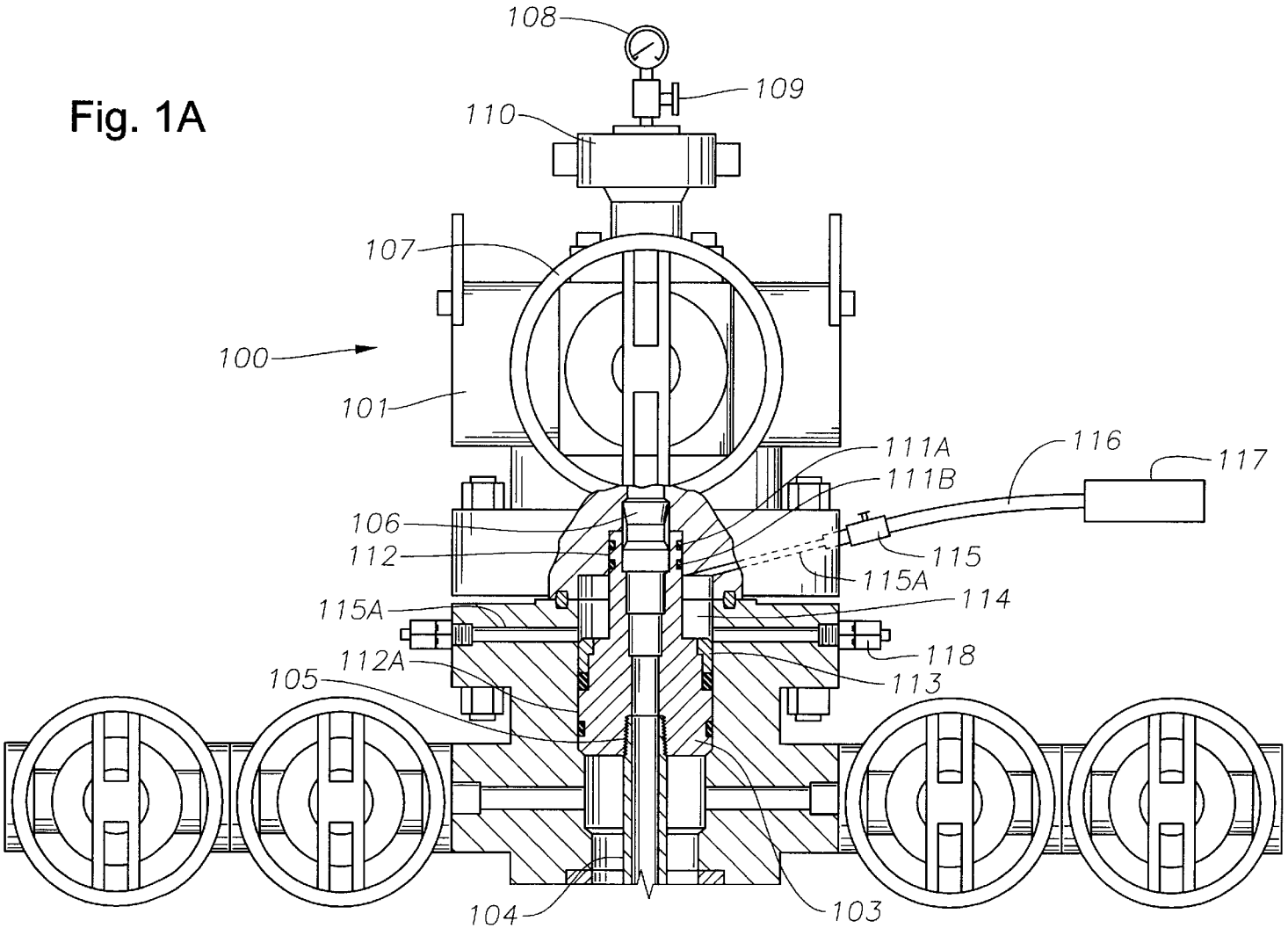
FIG. 1A is a partial exterior, partial vertical cross-sectional view of a Christmas tree assembly of a subterranean well showing the cavity between the sealing members and an injector in place extending to a line and compressor/pump assembly for introduction of an inert gas and a hydrocarbon marker therein.

Now, with first reference to FIG. 1A, there is shown a Christmas tree assembly 100 consisting generally of a block valve assembly 101 having an outer housing 102 through which is disposed a seal block securing the uppermost end of a production tubing conduit 104 threadedly secured to the block 103 at threads 105 and secured by means of a seal sleeve 106 to the housing 102. A conventional valve wheel 107 is disposed through the block valve assembly 101 for manipulating valves between open and closed positions. The Christmas tree assembly 100 has at its uppermost end a conventional pressure gauge and needle valve 109 disposed lowerly and in communication therewith and, in turn, secured to a tree cap adapter 110 which is secured at the uppermost end of the housing 102 of the block valve assembly 101.

The seal block 103 has a series of first seal members 111A and 111B radially disposed around the exterior of the uppermost end of the seal block 103 for sealing securement of the block 103 to a smooth interior wall surface 112 of the block 103. Likewise, a lower second seal assembly 113 is circumferentially disposed around the exterior of a lower portion of the seal block 103 for sealing engagement around an enlarged interior surface portion 112A of the housing 102. The seal members 111A, 111B and 113 bridge a cavity 114 defined therebetween and within the housing 102. Dotted line 115 in FIG. 1A represents an injection path extending between the uppermost end of the cavity 114 and an injector 115 which is, in turn, secured at one end thereof to a gas line 116 in communication with a compressor and pump assembly 117, which may be portable, and driven by gas or electricity. A bleed valve 118 is in communication with the line 116 for bleeding off pressure subsequent to verification of the absence of the hydrocarbon marker around the Christmas tree. Subsequent to removal of the injector 115, a threaded seal cap, such as cap 118, may be threadedly sealingly secured to the housing 102 to assure sealing integrity within the cavity 114.

Figure 1B:
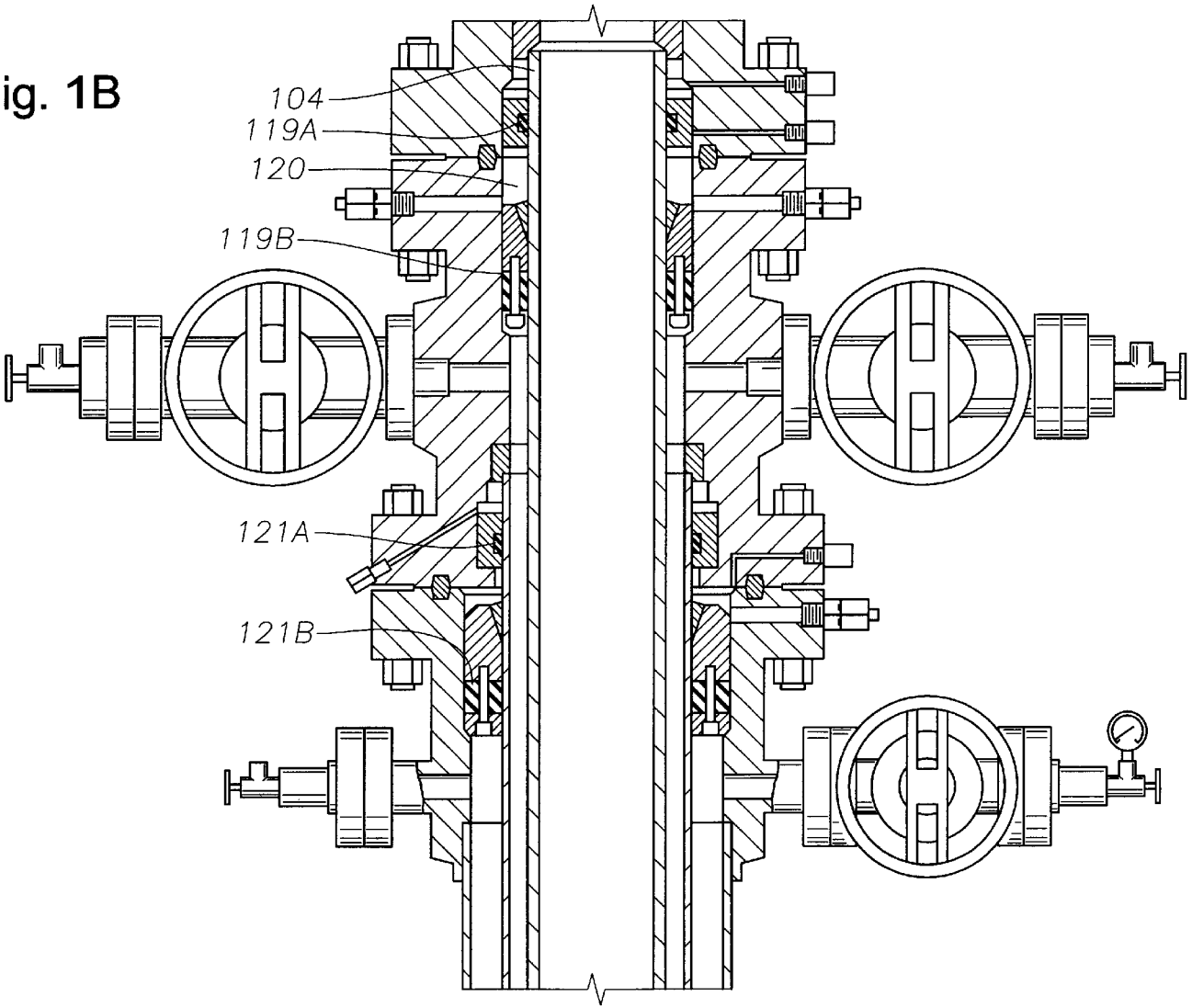
FIG. 1B is a view similar to that of FIG. 1A showing the seal means of the Christmas tree extending between enlarged concentrically disposed casing conduit members within the Christmas tree and the interior of the housing of the Christmas tree.

Turning now to FIG. 1B, similar components are like-numbered. FIG. 1B illustrates a series of additional seal assemblies 119A and 119B defining a cavity 120 therebetween exteriorly surrounding the production tubing 104. Additionally, the Christmas tree assembly 100 further includes lowerly of the cavity 120 a similarly disposed seal element 121A and 121B providing the seal means within the Christmas tree assembly 100 for engagement around the exterior of a casing conduit 122 concentrically disposed around the exterior of the production tubing 104.

When the casing and production tubing components are tied off at the top of the well, the Christmas tree assembly 100 is in place there-around with the production tubing 104 being secured at its uppermost end by threads 105 to the seal block 103. The seal sleeve 106 secures the seal block 103 to the interior of the housing 102 for hanging the production tubing therein. In order to assure that the seal members 111A, 111B and second seal assembly 113 have required sealing integrity relative to the interior surface 112A in the housing 102, the cap 118 is removed and the injector 115 is disposed relative to the injection path 115A, and the injector 115 extends to the line 116 which, in turn, is disposed relative to a combination compressor and pump assembly 117. The compressor and pump assembly 117 are used to introduce the combination of an inert gas with a gaseous hydrocarbon marker through the line 116, the injector 115 and into the injector path 115A to the cavity 114.

Any known inert gas may be used in conjunction with the present invention. By "inert" is meant any gaseous compound which will not react with the marker gas in such fashion that the marker cannot be detected during testing and which is safe and non-hazardous when used around oil and gas well Christmas trees. Preferably, nitrogen is used. The gaseous marker must be compatible with the selected inert gas and must be capable of being detected by smell, or the use of a conventional gas detection device sensitive to pre-determinable amounts of the particular marker. Any hydrocarbon-based gaseous marker may be utilized, such as freon, hydrogen, helium, or any other chlorofluorocarbon constituent or halogen-containing gaseous component.

As the gas and marker are introduced under pressure within the line 116 to the cavity 114, the pressure within the cavity is increased, considerably and, typically, up to about 20,000 psi. The absence of the marker in the atmosphere immediate the exterior of the Christmas tree is then verified by use of a hand-held verification device of known construction and availability to those skilled in the art or by detection of same through the human nose. If marker absence is verified, pressure within the line 116 and the cavity 114 is bled off through the bleed valve 118 so that pressure within the cavity 114 is approximately one atmosphere. The injector 115 is removed relative to the injector path 115A and a threaded seal cap 118 is secured to close the outer end of the injector path. Of course, if the absence of the marker is not verified and, in fact, the marker component is detected, the housing 102 of the Christmas tree assembly 100 may be removed, or opened, to permit replacement of the respective seal assemblies, or other remedial action taken. Regardless of the presence or absence of the marker in the atmosphere around the exterior of the Christmas tree, use of the present invention will result in the original seal means, or replacement or repaired seal means not being exposed thereafter to resulting oil or water corrosion or the like encountered as the result of use of prior art techniques.

During the method as above-described, pressure will normally be held at the increased and preselected first level for a period of about one hour. Thereafter, the pressure is reduced and the test gas is vented down to atmospheric pressure and the cavity and injector line sealed. It will be appreciated that use of the present method leaves the cavities between the seal assembly members filled with an inert gas at atmospheric pressure, thus enabling the gas to expand during well flow conditions but still be within the acceptable pressure limits of the sealing mechanisms.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A method for confirming the ceiling integrity of a seal system having members positioned in a cavity between a subterranean well conduit and an interior sealing surface of a Christmas tree valve assembly, comprising the steps of:

(a) introducing through a sealable opening of an injection path in communication with said cavity, into said cavity and between said seal members a first inert gas containing with a gaseous hydrocarbon marker;

(b) increasing pressure within said cavity a first pre-determinable amount;

(c) verifying the absence of said marker in the atmosphere immediate the exterior of the Christmas tree valve assembly;

(d) decreasing pressure within said cavity to a second pre-determinable amount lower than said first pre-determinable amount; and (e) sealing said opening of said injection path.

* * * * *